United States Patent [19]

Cantley et al.

[11] 4,020,713

[45] May 3, 1977

[54] STATION CONTROL SELECTION SYSTEM

[75] Inventors: George A. Cantley, Akron; John E. Litzell, Hudson, both of Ohio

[73] Assignee: Incom International Inc., Pittsburgh, Pa.

[22] Filed: Oct. 16, 1974

[21] Appl. No.: 515,185

[52] U.S. Cl. ..... 74/479; 74/480 B; 74/483 R

[51] Int. Cl.[2] ..... G05G 5/06

[58] Field of Search ..... 74/483 R, 479, 480 B, 74/502; 114/146

[56] References Cited

UNITED STATES PATENTS

| | | | |
|---|---|---|---|
| 3,286,544 | 11/1966 | Gilmore et al. | 74/483 |
| 3,526,152 | 9/1970 | Farrington et al. | 74/479 |
| 3,842,689 | 10/1974 | Bagge | 74/483 R |

*Primary Examiner*—William F. O'Dea
*Assistant Examiner*—Harold Joyce
*Attorney, Agent, or Firm*—James C. Wray

[57] ABSTRACT

A system is provided for controlling a motor and rudder of a power boat selectively from either of two remote stations, each of which includes means for producing linear input signals for motor shift and throttle control and for steering control. The system includes a steering input selector mechanism which is capable of transmitting the linear input signal for steering control from one of the stations to the rudder while isolating the signal from the other station. A motor input selector mechanism is capable of transmitting the linear input signals for motor shift and throttle control from one of the stations to the motor while isolating the signals from the other station. The steering and motor input selector mechanism may be actuated to facilitate the selection of one of the stations whenever corresponding linear input signals from the two stations are substantially equal. The system also includes a mechanism for initiating the actuation of selection of one of the stations prior to the corresponding linear input signals from the two stations being substantially equal.

21 Claims, 9 Drawing Figures

STATION CONTROL SELECTION SYSTEM

BACKGROUND OF THE INVENTION

1. Field of the Invention

This invention relates to a system for selectively controlling a power boat from either of two remote stations and, more specifically, to such a system which utilizes input selector mechanisms for steering and motor control which can be activated to transmit input signals to the motor and rudder from the selected station while those from the other station are isolated.

2. Description of the Prior Art

It is often desirable in the operation of power boats to have at least two remote control stations, one of which might be located, for example, within the cabin and the other on the flying bridge. To allow control of the motor and/or rudder from either station a number of devices and systems such as those disclosed in U.S. Pat. Nos. 2,358,094; 2,705,435; 3,128,738; 3,526,152; and 3,651,709 have been heretofore provided.

However, it can be readily seen that many of these and other such devices in the prior art are specifically applicable for forward or reverse selection, throttle regulation, or steering control, but are not directed toward nor compatible with all of the controls required for the operation of the motor and rudder at each station. Accordingly, they do not disclose nor suggest a device which may be employed for motor shift and throttle controls and for rudder control which can be utilized in a system by which total control can readily and easily be assumed at one station to the exclusion of the other.

Further, a number of the varied means employed for station selection imposes restrictions and limitations on the operation of the boat because of the manner in which control may be shifted from one station to the other. For example, some steering selection devices require the rudder, and thus both steering wheels, to be amidship to shift station control. Some of the prior art motor control selectors in a similar manner require the throttle at both stations to be at a zero or idle position prior to station selection. It has also be observed that a device employed to select the station having throttle control may not be applicable for nor compatible with the selection of motor shift control for that station. A simple adaption of some of the prior art selector devices for both motor shift and motor throttle control would not insure that the station having shift control would also have throttle control.

The limitations of the devices and systems heretofore utilized for station selection are most apparent during critical maneuvering periods of the boat when the station shifting is most important. It might be desirable, for example, while maneuvering to retrieve a man overboard or while proceeding through a narrow channel against the current to shift controls from within the cabin to the flying bridge for better visibility. All controls should be shifted as quickly as possible and rudder and throttle control should be maintained, without effective loss, at all times. Failing to satisfy these requirements, the above-mentioned prior art devices and systems do not provide a coordinated means for simple, rapid station selection and do not facilitate selection in a manner which is consistent with safe, reliable operation of the boat throughout shifting of the stations.

SUMMARY OF THE INVENTION

It is therefore an object of the invention to provide a system for rapid, simply selection of one station for operating a power boat to the exclusion of the other station.

It is a further object to provide a selector device for a system of the type described by which the various motor and rudder controls are capable of being shifted from one station to the other without loss of power and/or steering.

It is another object to provide a selector device of the type described for motor shift and throttle control which will insure that both the shift control and the throttle control will be shifted to the selected station at the same time.

To accomplish these and other objects of the invention, a preferred embodiment threof includes a system for selectively controlling a power boat having a motor and a rudder from either of two remote stations. Each of the remote stations includes means for producing linear input signals capable of more shift and throttle control and of steering control. The system includes a steering input selector mechanism capable of transmitting the linear input signal for steering control from one of the stations to the rudder for steering control at the one station while isolating the linear input signal for the steering control from the other station. The system also includes a motor input selector mechanism capable of transmitting the linear input signal for motor shift and throttle control from one of the stations to the motor while isolating the linear input signal for motor shift and throttle control from the other station. The steering input selector mechanism and the motor input selector mechanism are capable of activation to facilitate the selection of the one station whenever corresponding linear input signals from the two stations are substantially equal. There also includes in the system means for initiating the activation to facilitate the selection of one of the stations prior to the corresponding linear input signals from the two stations being substantially equal.

BRIEF DESCRIPTION OF THE DRAWINGS

FIG. *5a* is a view of the mechanism of FIG. 3 as seen along line *5a—5a.

DETAILED DESCRIPTION OF THE PREFERRED EMBODIMENTS

Figure 1:
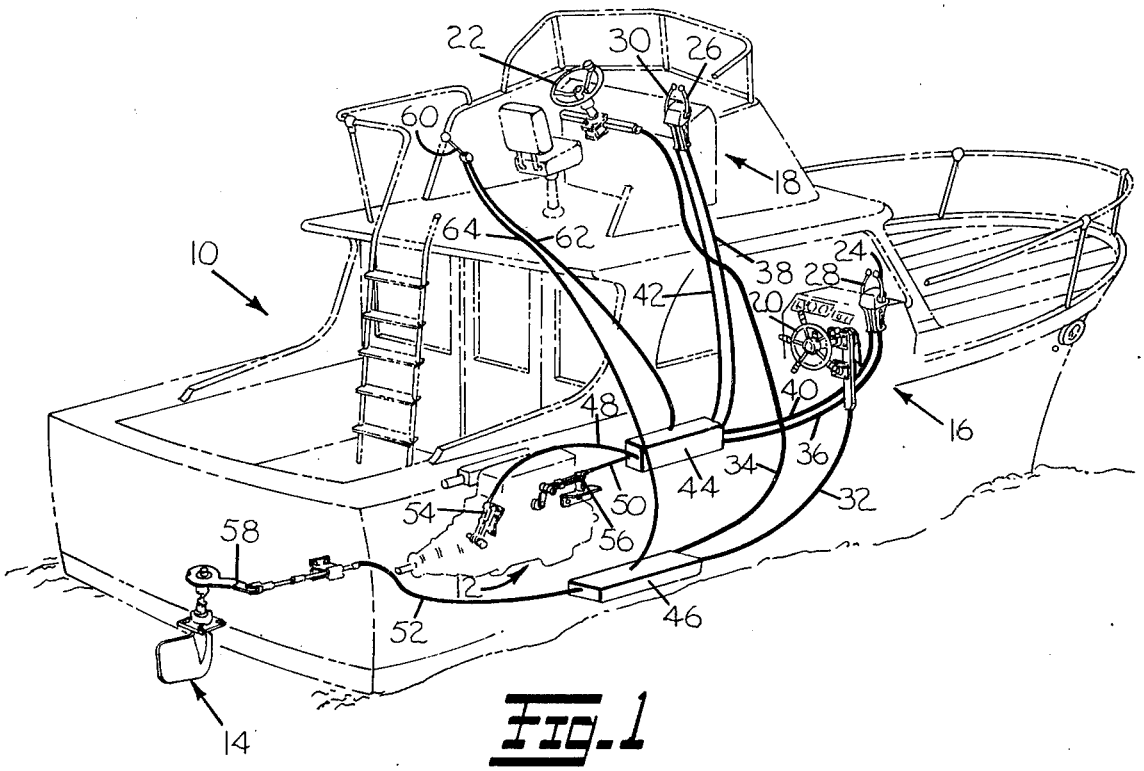
FIG. 1 is a schematic view of a typical installation of the preferred station selection system including various features of the invention.

As seen in schematic form in FIG. 1, the preferred station selection system is installed in a power boat 10 propelled and directed by a motor 12 and rudder 14. It will be apparent throughout the description provided herein and in the claims that follow that any reference to the "rudder" for "steering" the boat would include and be equally applicable for a pivotally mounted propeller rig of an inboard'outboard motor configuration or of an outboard motor, both of which is well known in the power boat art.

In the preferred embodiment of the invention, the controls for the motor 12 and rudder 14 are located at two stations, a cabin station 16 and a flying bridge station 18. Each station 16, 18 respectively includes a steering control wheel 20, 22; a motor shift control lever 24, 26; and a motor throttle control lever 28, 30. Each of the controls 20 through 30 is capable of generating a linear movement in a manner known in the marine control art and of transmitting this input movement to a remote location through a corresponding relative movement of the inner core of a control cable. Accordingly, each control 20, 22, 24, 26, 28 and 30 respectively has an associated input cable 32, 34, 36, 38, 40 and 42.

However, in accordance with the preferred station selection system of the present invention, the input cables 32 through 42, rather than being directly affixed to the motor 12 and/or rudder 14, are terminated at a motor shift and throttle selector mechanism 44 and/or steering selector mechanism 46 in a manner which will be described in detail hereinbelow during an explanation of the mechanisms 44, 46. It is presently sufficient for an appreciation of the basic system to understand that the linear input movements from the selected station 16 or 18 are transmitted by the motor selector mechanism 44 to a shift output cable 48 and a throttle output cable 50 and by the steering selector mechanism 46 to a steering output cable 52.

The inner core of the shift output cable 48 is affixed to a shift arm 54 on the motor 12 for relative movement thereof to cause the motor 12 to be operating in a head direction in neutral, or in a stern direction as determined by the shift control lever at the selected station. The inner core of the throttle of the output cable 50 is affixed to a throttle arm 56 on the motor 12 for relative movement thereof to control motor power output from the selected station from the zero throttle or idle condition to a full throttle condition. Similarly, the inner core of the steering output cable 52 is affixed to the rudder tiller arm 58 for movement thereof to position the rudder 14 at a location between left full rudder and right full rudder corresponding to the position of the steering control wheel 20 or 22 of the selected station 16 or 18.

To complete the station selection system as shown in FIG. 1, a station selection initiating lever 60, which may be rotated to either of two positions, one for cabin control and the other for bridge control, is provided. The position of the initiating lever 60 determines the relative position of an inner core of a motor selector initiating cable 62 and the relative position of an inner core of a steering selector initiating cable 64 which extend from the lever 60 respectively to the mechanisms 44 and 46. How the position of the lever 60 "initiates" selection of the desired station and thereby enables the mechanisms 44, 46 to transmit the selected linear input movements will be discussed in detail hereinbelow.

Figure 5A:
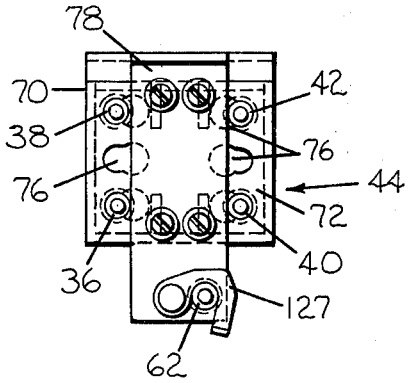
FIG. 5b* is a view of the mechanism of FIG. 3 as seen along line *5b—5b.*
Figure 5B:
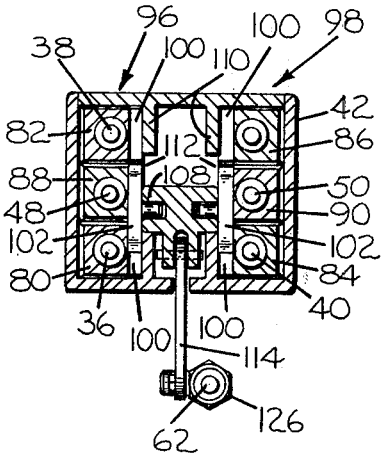

Turning to FIGS. 3, 4, 5*a* and 5*b*, the preferred motor shift and throttle selector mechanism 44 includes an elongated support housing 70 having a forward end 72 and a rearward end 74. The outer casing of each input cable 36, 38, 40 and 42 is secured to the forward end 72 of the housing 70 at openings 76 by a mounting plate 78 as the inner cores extend inwardly thereof. The cables 36, 38, 40 and 42 are respectively aligned, as seen in FIGS. 5*a* and 5*b*, with input members 80, 82, 84 and 86 slidably retained within the housing 70 and capable of moving longitudinally therein. In a similar manner, the outer casings of the output cables 48 and 50 are secured to the rearward end 74 of the housing 70 with the inner cores respectively aligned with the output members 88 and 90 which are slidably mounted for longitudinal movement within the housing 70. Each of the inner cores is secured to the interior 92 of its respective member with a longitudinally adjustable fitting 94.

It can be seen by one skilled in the cable art that the members by their being capable of being reversed in position within the housing 70 and the ends 72, 74 of the housing 70 by their having additional openings 76 are designed to satisfy almost any combination of push or pull cable as might be required by the station controls or motor utilized. Accordingly, the cables may be directed to or from the housing 70 from either end for either push or pull operation of the inner core to produce the linear movement of the members within the housing 70 consistent with the required transfer of motion for motor operation. Specifically, the mechanism 44 includes a shift section 96 and a throttle section 98 each of which respectively includes the appropriate above-mentioned members. In shift section 96, the input members 80, 82 and shift output member 88 therebetween are secured to the cables and adjusted to be longitudinally aligned with each other when each of the controls 24, 26 and the arm 54 which they would respectively control are in the same forward, neutral, or reverse position. In a similar manner, the members of the throttle section 98 are longitudinally aligned with each other for each position of the throttle representing equal throttle magnitudes.

With the members capable of aligned linear movement within their respective sections 96 and 98, it is essential to provide a means for connecting the input member of the selected station with the output member. For this purpose, each member has in its side facing inwardly of the housing 70 a transverse groove 100. The grooves 100 are aligned one with the others when each member of section 96 and 98 is longitudinally aligned with the other members of its section. A key 102 extending from the groove 100 of the output member and into the groove 100 of the selected input member insures the longitudinal movement of one is transferred to the other. The key 102 is slightly tapered at the ends for easy alignment during station selection and has a limited length to prevent its extension into the groove 100 of the non-selected input member, so that only the selected member is connected to the output member. To selectively locate the key 102 of each section 96, 98 within the grooves 100, each key 102 includes a locating pin 104 on its side remote from the grooves 100. Each pin 104 is adapted for and slidably received within a channel 106 on its respective side of an elongated selector guide 108 disposed within the housing 70 between the keys 102 and sections 96 and 98. The selector guide 108 is capable of lateral movement between interior walls 110 of the housing 70 to cause the keys 102, under the urging of the channels 106 to be moved relative the members within the grooves 100. The dimensions of the guide 108, the distance between the walls 100, and the length of the keys 102 as referred to hereinabove insure that the lateral movement of the guide 108 is limited by making contact with the walls 110 and thereby assumes a position which withdraws the keys 102 from the groove 100 of the non-selected members as shown with members 82 and 86 at 112 in FIGS. 3 and 5*b*.

Figure 3:
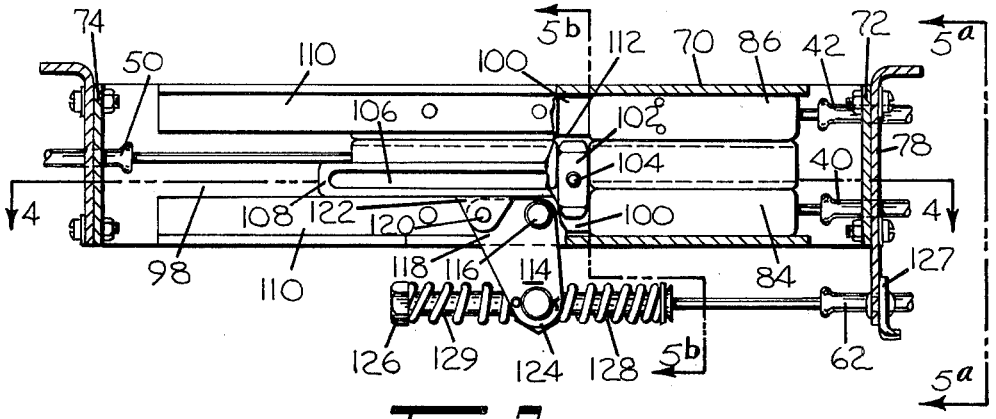
FIG. 3 is a sectional view of the preferred motor shift and throttle selector mechanism.

As best seen in FIG. 3, the lateral position of the guide 108 is controlled by a lever 114 pivotally mounted at 116 between the lower pair of interior walls 110. The guide 108 is pivotally secured to a first end 118 of the lever 114 by a pin 120 extending therethrough between a pair of lug members 122 depending from the guide 108. The second end 124 of the lever 114 is adapted to receive a spring link assembly 126 which enables the lever 114 to be positioned by the action of the inner core of the motor selector initiating cable 62, the outer casing of which is secured at 127 to the housing 70, and the station selection initiating lever 60. A pair of springs 128, 129 of the spring link assembly 126 apply a force to the end 122 for movement of the lever 114 as determined by the cable 62 and initiating lever 60 which will be explained in detail hereinbelow.

As shown in FIG. 3, the guide 108 is in a lowered position to connect the controls of the cabin station 16 to the motor 12 by the end 122 of lever 114 being positioned toward the right. Repositioning the station selection initiating lever 60 to shift control to the bridge station 18 will cause the inner core of the cable 62 to move to the left so that the spring 128 will apply a force to the end 122 which tends to move the lever 114 in a clockwise direction. However, actual movement of the lever 114 is only possible if the guide 108 is free to move upwardly.

Since both keys 102 are prevented by channel 106 from lateral movement with respect to the guide 108, both keys must be capable of upward movement into the grooves 100 of members 82 and 86 before the guide 108 or lever 114 can move. Therefore, only when both members 82 and 86 are respectively aligned with the output members 88 and 90, by manipulation of the controls at either or both stations if desired, will the guide 108 be able to move upwardly under the influence of the spring 128 and lever 114 to shift controls. When both keys 102 extend into the groove 100 of the members 82 and 86, upward movement of the guide 108 will continue until it rests against the upper pair of interior walls 110. With the station initiating lever 60 maintained in the bridge position, the cable 62 and spring 128 will cause the guide 108 to remain in position against the upper walls 110 so that motor control will be from the bridge station and the controls and associated input members of the cabin station 16 will be isolated from the output members for independent relative movement therebetween.

When the station selection initiating lever 60 is returned to the cabin position, the events above are repeated with the other spring 129 applying a force to rotate the lever 114 in a counterclockwise direction. The actual shifting of controls will again require both the throttle and shift controls to be aligned with the output members so that they will be simultaneously assumed at the cabin station 16.

Looking now at FIGS. 6, 7 and 8 of the preferred steering selector mechanism 46, it can be seen that a principle similar to that employed hereinabove for a mechanism 44 is again utilized but is specifically adapted for steering control because of the greater forces and the heavier loads required. An elongated housing 140 having a longitudinal opening 142 in its top side includes end plates 144, 146. The outer casing of steering input cables 32 and 34 and of steering output cable 52 are respectively secured to ends 144 and 146 with their inner cores extending into the housing 140. Each inner core is respectively secured to an associated cabin steering input slide 148, bridge steering input slide 150, and steering output slide 152, each of which is capable of sliding, longitudinal movement within the housing 140.

Each slide 148, 150 includes a longitudinal 154 extending outwardly of its outer wall to make sliding contact with the interior surface of the housing 140. A longitudinal channel 156 in the inward wall of each slide 148, 150 is adapted to slidably receive therein a guide 158, similar to guide 154 above, mounted at each side of the output side 152. The general infoldment of the slides 148, 150 by the housing 140 and the entrapment by each slide 140, 150 of the guides 158 of the output slide 152 disposed therebetween insures lateral alignment of each slide 148, 150, 152 with the other slides and the housing despite the existence of opening 142 at the top of housing 140.

Being capable of only longitudinal movement within the housing 140, the slides 148, 150, and 152 are initially secured to the inner cores of their respective cables so that all of the slides 148, 150, 152 are longitudinally aligned when the position of the controls and the rudder are identical. To facilitate the coupling of the selected input slide with the output slide, each slide 148, 150, 152 is respectively provided a transverse groove 160, 162, 164 in its upper surface which grooves are aligned one with the others when the slides are aligned.

A rocking member 168 is pivotally mounted within the groove 164 of the output slide 152 and includes a first end 170 and a second end 172 respectively alignable with the grooves 160 and 162. Each end 170, 172 includes a roller 173 facing its respective input slide. The shape of the rocking member 168 is such that when one end of 170, 172 is fully engaged with its respective groove 160, 162, the other end 170, 172, is withdrawn from any contact with and out of the path of the other input slide 148, 150.

An actuation arm 174 is pivotally mounted at 176 on the output slide 152 to position the rocking member 168 as its extended end 178 acts on an upper cam surface 180 of the member 168. As seen in FIG. 8, positioning the extended end 178 of the arm 174 to the right causes the member 168 to rotate clockwise as the end 170 extends into the groove 160 to be maintained therein to connect the input slide 148 and the output slide 152. Moving the end 178 to the left would connect the input slide 150 with the output slide 152 while releasing the input slide 148. The position of the actuation arm 174 is determined by the spring link assembly 180, like assembly 126 utilized on the motor shift mechanism 44 described hereinabove, and by the position of the station selection initiating lever 60 and its associated cable 64 for steering selection. The outer casing of the cable 64 is mounted to the slide 152 to allow the slide 152 to move within the housing 140 and to cause the inner core to be unaffected by the longitudinal movement as its relative movement within the cable 64 positions the arm 174 relative to the slide 152.

Figure 6:
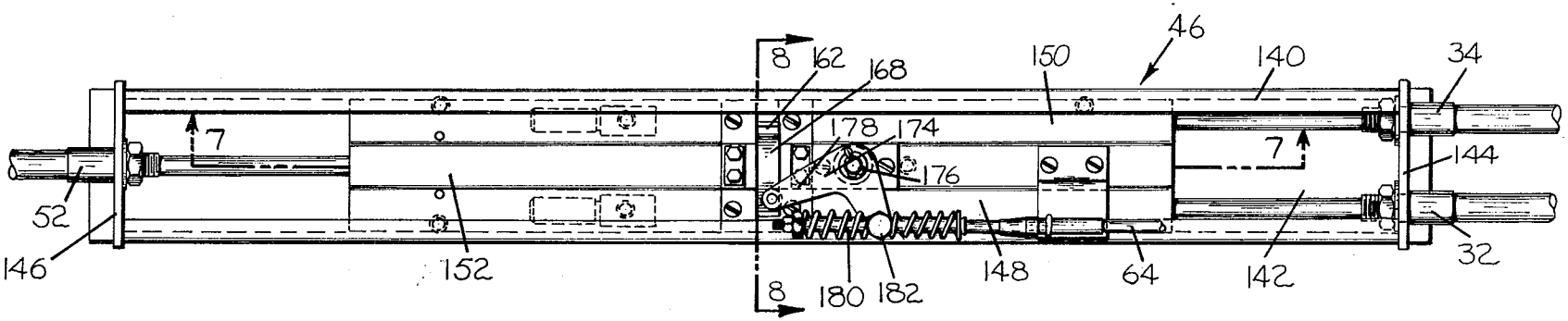
FIG. 6 is a top view of the steering selector mechanism.
Figure 7:
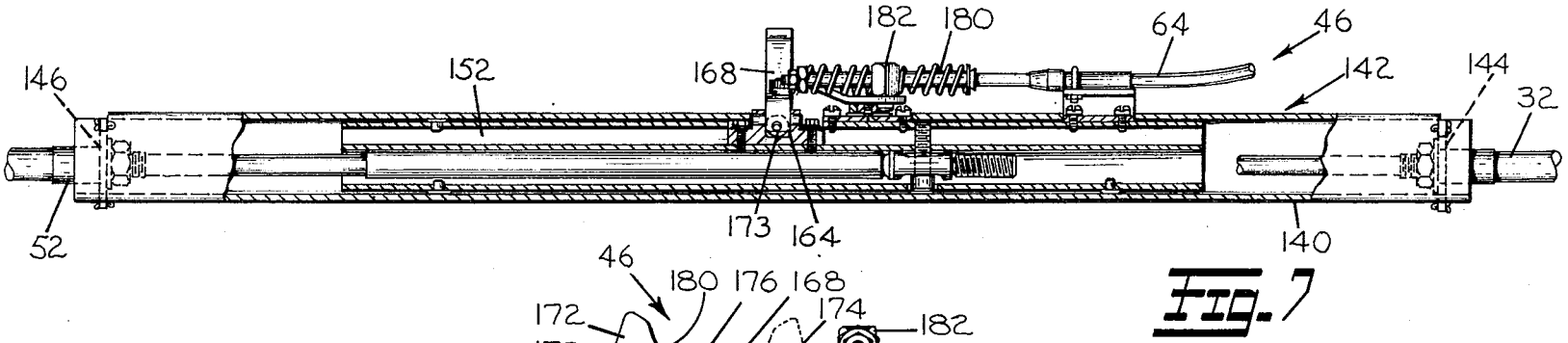
FIG. 7 is a view of the mechanism of FIG. 6 as seen generally along line 7—7.
Figure 8:
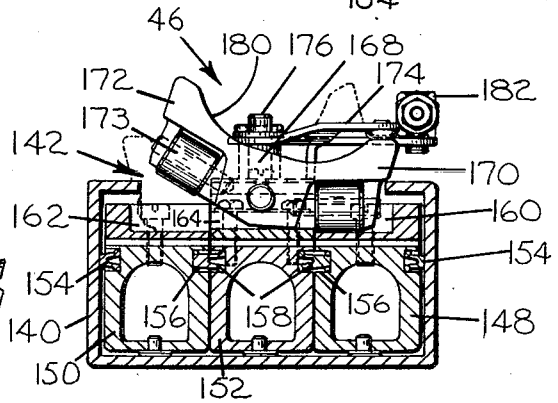
FIG. 8 is a view of the mechanism of FIG. 6 as seen along line 8—8.

As shown in FIGS. 6 and 7, the inner core of cable 64 is drawn to the right so that the spring-like assembly 180 has caused the arm 174, to which it is pivotally connected at 182, to have rotated in a counterclockwise direction. As seen in FIG. 8, the extended 178 of the arm 174 has cammed the rocking member 168 toward the right for steering control at the cabin station 16. The slide 150 is not connected to the output slide 152 and is free to move relative thereto so that the steering control 22 of the bridge station 18 is located from the rudder 14.

Shifting the station selection initiating lever 60 to bridge control produces a biasing action on the extended end 178 as it attempts to reposition the rocking member 168. The rocking member 168 will not rotate, however, until the slides 150 and 152, and their respective grooves, are longitudinally aligned. As seen in FIG. 8, the biasing will cause the roller 173 to press against and roll along the top of slide 150 until it is aligned with the groove 162. According, the actual connection of the slides 150 and 152, and the resulting control at the bridge station 18, will not occur until the rudder 14 and the steering control 22 are similarly positioned. However, shifting can occur at any rudder angle desired.

Figure 2:
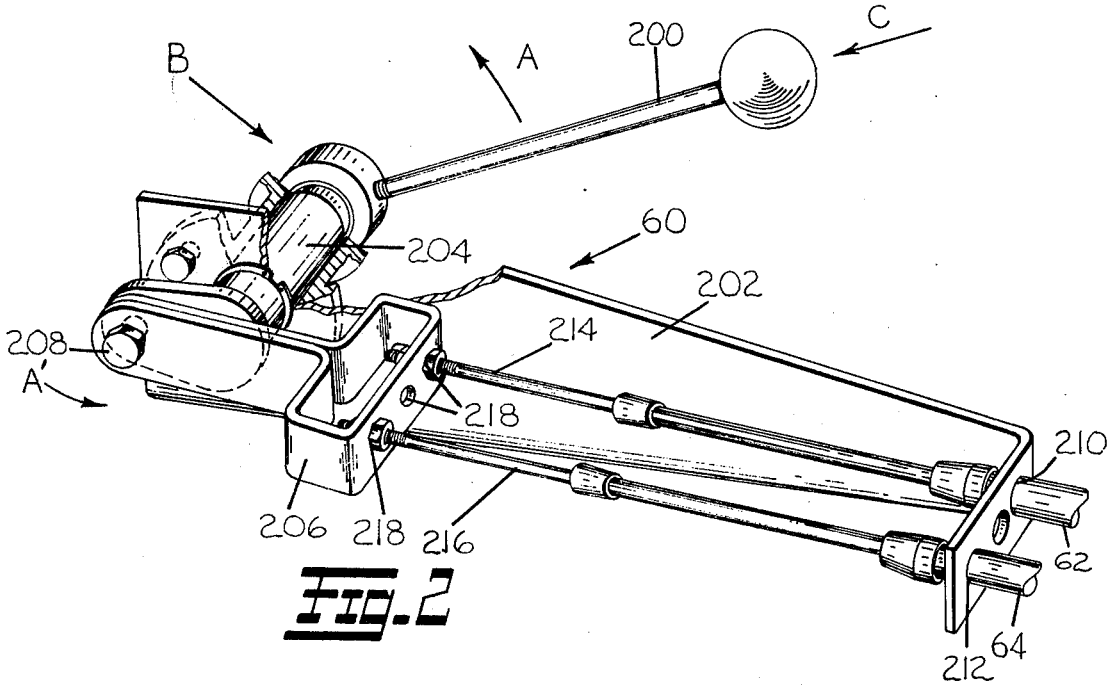
FIG. 2 is a fragmented, perspective view of the preferred station selection initiating mechanism.
Figure 4:
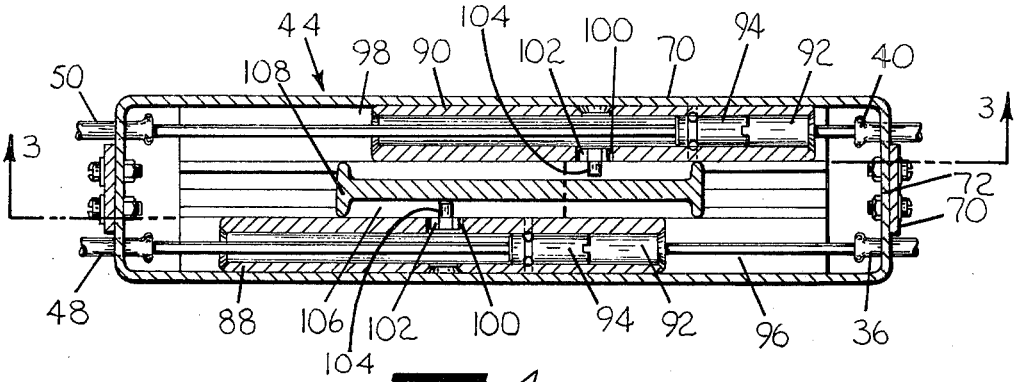
FIG. 4 is a view of the mechanism of FIG. 3 as seen along line 4—4.

Turning to FIG. 2, the preferred station selection initiating lever 60 includes a handle 200 pivotally mounted for rotation on mounting frame 202 about an axis 204. The handle 200 is shown in the cabin position C and is free to rotate in the direction A to the bridge position B. A stirrup fitting 206 is pivotally mounted at 208 to the end of the axis 204 remote from the handle 200. The mounting at 208 is not aligned with the center of axis 204 so that rotation of the handle 200 in the direction A will cause the mounting 208 to move in the direction A'.

The outer casings of the motor selector initiating cable 62 and the steering selector initiating cable 64 are respectively secured to the frame 202 at 210 and 212. The respective inner cores 214 and 216 of cables 62 and 64 are secured to the stirrup fitting 206 at holes 218. Accordingly, in the position shown in FIG. 2, the inner cores 214 and 216 are pulled to the left when the handle 200 is in the cable position C. This position causes the cables 62 and 64 to be in a position for cabin control as has been reflected in the Figures discussed hereinabove including the selector mechanisms 44 and 46. Moving the handle 200 in the direction A will initiate station shifting for eventual control at bridge station 18. Actual control of the motor 12 and the rudder 14, however, as discussed above, will not occur until the input movement from the bridge station 18 is identical to that actually being maintained at the motor and rudder. Returning the handle 200 from the position B to the position C will initiate shifting to the cabin station 16 for eventual control of the motor and rudder from the cabin.

It can be seen that it would be possible when shifting from cabin to bridge control for the bridge to assume motor control prior to the assumption of steering control or vice versa. However, it should be apparent to one familiar with the operation of a power boat that the operator with the system disclosed herein could initiate station shifting, could rapidly assume control of both the motor and rudder from the new station and could readily alter them if desired.

It should be apparent from the discussion of mechanism 44 and 46 and the station selection inititing lever 60 that an alternative means might be employed to initiate station selection. For example, a pair of electrically operated solenoids might be utilized to operate the spring-like assemblies rather than the cables 62 and 64. Further, as evidenced in FIG. 2 by the additional holes in the stirrup fitting 206 and frame 202, the station selection initiating lever 60 could accommodate an additional initiating cable. The system is therefore capable of being utilized on a power boat having two motors with an addition set of motor controls and an additional motor selector mechanism. Accordingly, the present invention is not limited to the preferred embodiments described hereinabove, but the disclosure provided will enable one to practice the invention by utilizing other means while nevertheless being within the scope of the invention as claimed.

We claim:

1. A control selector mechanism comprising:

a support housing;

a pair of input members, each of which is slidably mounted within said support housing and capable of responding to a linear input movement having predetermined limits;

an output member mounted within said support housing for sliding in a direction generally parallel with said pair of input members;

means for connecting said output member to one of said pair of input members and for simultaneously disconnecting said output member from the other of said pair of input members so that said output member will produce a linear output movement corresponding to said linear input movement of said one of said pair of input members; and means for initiating said actuation of said connecting and disconnecting means independently of the relative positions of said one of said other of said pair of input members.

2. A mechanism as set forth in claim 1 wherein said output member is disposed between said pair of input member and said connecting and disconnecting means includes a rocking member which is mounted on said output member for pivotal movement about an axis which is generally parallel with said linear input movement and said linear output movement, said rocking member having a pair of extended ends each of which are respectively capable of being received within a groove in a first side of each said input member as the other of said extended ends is withdrawn from the other of said grooves.

3. A mechanism as set forth in claim 2 further including a lever means having a first and a second end and pivotally mounted on said output member for movement between a first and a second position by the application of initiating force at said first end, said second end being aligned for sliding contact with said extending ends of said rocking member and thereby capable of selectively directing said extended ends into said grooves by said application of said initiating force causing said lever means to be located at a selected one of said first and second positions.

4. A mechanism as set forth in claim 3 further including a selection initiating means operable between a first and a second position for respectively selecting said input member to be connected to said output member, said selection initiating means being connected to said first end of said lever means through biasing means for said application of said initiating force in a direction for pivoting said lever means toward said first and said second positions of said lever means when said selection initiating means is respectively in its said first and said second position.

5. A mechanism as set forth in claim 4 wherein said each of said extended ends of said rocking member includes a roller portion for rolling contact with a corresponding said first side of said input member when said extended end is being pivoted theretoward by the positioning of said selection initiating means and is displaced along said first side from its corresponding said groove preventing its receipt therein.

6. A mechanism as set forth in claim 1 wherein said output member is disposed between said input members and said connecting and disconnecting means includes a key mounted for sliding movement in a transverse groove in one side of said output member, said key having one end of which is capable of extending past said groove into a receiving groove in said one of said pair of input members as the other end of said key is withdrawn from a receiving groove of said other of said pair of input members.

7. A mechanism as set forth in claim 6 wherein said key includes a pin extending away from said output member to be received within an elongated channel in one side of a locating guide, said channel being parallel with said output member and capable of selectively positioning said key with respect to said groove of said output member by said locating guide being mounted within said housing for selective movement in a transverse direction with respect to said linear input and output movement, and said pin being capable of sliding along said channel during said linear output movement of said output member independently of the position of said key with respect to said groove.

8. A mechanism as set forth in claim 7 including means for initiating said selective movement of said locating guide by applying a force in said transverse direction and toward said one of said pair of input member, said one end of said key sliding along a surface of said one of said pair of input members until said pair of input members are at said substantially corresponding locations and said force causes said one end to be extended into said receiving groove of said one of said pair of input members.

9. A mechanism as set forth in claim 6 wherein said pair of input members, said output member and said key facilitate selection of a first control, further including a facilitate selection of a second control an additional pair of input members, an additional output member and an additional key respectively like said pair of input members, said output member, and said key and being correspondingly mounted in said support housing with said locating guide disposed therebetween, said locating guide having an additional elongated channel like said elongated channel in a side opposite said one side to receive the pin of said additional key therein whereby said selective movement of said locating guide in said transverse direction facilitates simultaneous selection of said first and said second controls.

10. A mechanism as set forth in claim 9 including means for initiating said selective movement of said locating guide by applying a force in said transverse direction and toward said one of said pair of input member and a corresponding one of said additional pair of input members, said selection of said first and said second controls requiring both said pair of input member and said additional pair of input members to be simultaneously respectively at said substantially corresponding locations.

11. A control selector mechanism comprising a support housing; a pair of input members, each of which is slidably mounted within said support housing and capable of responding to a linear input movement having predetermined limits, an output member mounted within said support housing for sliding in a direction generally parallel with said pair of input members, and means for connecting said output member to one of said pair of input members and for simultaneously disconnecting said output member from the other of said pair of input members so that said output member will produce a linear output movement corresponding to said linear input movement of said one of said pair of input members, wherein said connecting and disconnecting means is capable of being actuated at any location within said limits of said linear input movement of said other of said pair of input member when said one of said pair of linear input members is substantially correspondingly located within said limits of its respective said linear input movement.

12. A mechanism as set forth in claim 11 further including means for initiating said actuation of said connecting and disconnecting means independently of the relative locations of said one of said other of said pair of input members.

13. A mechanism as set forth in claim 11 wherein said output member is disposed between said pair of input member and said connecting and disconnecting means includes a rocking member which is mounted on said output member for pivotal movement about an axis which is generally parallel with said linear input movement and said linear output movement, said rocking member having a pair of extended ends each of which are respectively capable of being received within a groove in a first side of each said input member as the other of said extended ends is withdrawn from the other of said grooves.

14. A mechanism as set forth in claim 13, further including a lever means having a first and a second end and pivotally mounted on said output member for movement between a first and a second position by the application of initiating force at said first end, said second end being aligned for sliding contact with said extended ends of said rocking member and thereby capable of selectively directing said extended ends into said grooves by said application of said initiating force causing said lever means to be located at a selected one of said first and second positions.

15. A mechanism as set forth in claim 14, further including a selection initiating means operable between a first and a second position for respectively selecting said input member to be connected to said output member, said selection initiating means being connected to said first end of said lever means through biasing means for said application of said initiating force in a direction for pivoting said lever means toward said first and said second positions of said lever means when said selection initiating means is respectively in its said first and said second position.

16. A mechanism as set forth in claim 15, wherein said each of said extended ends of said rocking member includes a roller portion for rolling contact with a corresponding said first side of said input member when said extended end is being pivoted theretoward by the positioning of said selection initiating means and is displaced along said first side from its corresponding said groove preventing its receipt therein.

17. A mechanism as set forth in claim 11 wherein said output member is disposed between said input members and said connecting and disconnecting means includes a key mounted for sliding movement in a transverse groove in one side of said output member, said key having one end of which is capable of extending past said groove into a receiving groove in said one of said pair of input members as the other end of said key is withdrawn from a receiving groove of said other of said pair of input members.

18. A mechanism as set forth in claim 17 wherein said key includes a pin extending away from said output member to be received within an elongated channel in one side of a locating guide, said channel being parallel with said output member and capable of selectively positioning said key with respect to said groove of said output member by said locating guide being mounted within said housing for selective movement in a transverse direction with respect to said linear input and output movement, and said pin being capable of sliding along said channel during said linear output movement of said output member independently of the position of said key with respect to said groove.

19. A mechanism as set forth in claim 18 including means for initiating said selective movement of said locating guide by applying a force in said transverse direction and toward said one of said pair of input member, said one end of said key sliding along a surface of said one of said pair of input members until said pair of input members are at said substantially corresponding locations and said force causes said one end to be extended into said receiving groove of said one of said pair of input members.

20. A mechanism as set forth in claim 18 wherein said pair of input members, said output member and said key facilitate selection of a first control, further including a facilitate selection of a second control an additional pair of input members, an additional output member and an additional key respectively like said pair of input members, said output member, and said key and being correspondingly mounted in said support housing with said locating guide disposed therebetween, said locating guide having an additional elongated channel like said elongated channel in a side opposite said one side to receive the pin of said additional key therein whereby said selective movement of said locating guide in said transverse direction facilitates simultaneous selection of said first and said second controls.

21. A mechanism as set forth in claim 20 including means for initiating said selective movement of said locating guide by applying a force in said transverse direction and toward said one of said pair of input member and a corresponding one of said additional pair of input members, said selection of said first and second second controls requiring both said pair of input member and said additional pair of input members to be simultaneously respectively at said substantially corresponding locations.

* * * * *

UNITED STATES PATENT AND TRADEMARK OFFICE

CERTIFICATE OF CORRECTION

PATENT NO. : 4,020,713

DATED : May 3, 1977

INVENTOR(S) : George A. Cantley et al.

It is certified that error appears in the above-identified patent and that said Letters Patent are hereby corrected as shown below:

Column 8, line 35, "one of" should read -- one and --;

Column 8, line 38, "member" should read -- members --.

Column 9, line 47, "a facilitate" should read --, to facilitate --;

Column 9, line 47, "control" should read -- control, --.

Column 10, line 26, "one of" should read -- one and --.

Column 12, line 8, "a facilitate" should read -- , to facilitate --;

Column 12, line 8, "control" should read -- control, --.

Signed and Sealed this

*Tenth* Day of *July 1979*

[SEAL]

*Attest:*

*Attesting Officer*

LUTRELLE F. PARKER

*Acting Commissioner of Patents and Trademarks*